US005152029A

United States Patent [19]

Pai

[11] Patent Number: 5,152,029

[45] Date of Patent: Oct. 6, 1992

[54] HYDRAULIC HINGE

[75] Inventor: Tung-Ching Pai, Nan-Tou Hsien, Taiwan

[73] Assignee: King Chain Precision Industry Co., Ltd., Taiwan

[21] Appl. No.: 743,795

[22] Filed: Aug. 12, 1991

[51] Int. Cl.[5] ..... E05F 3/08

[52] U.S. Cl. ..... 16/54; 16/55

[58] Field of Search ..... 16/54, 55

[56] References Cited

U.S. PATENT DOCUMENTS 3,074,101 1/1963 Hideyoshi ..... 16/54

3,401,422 9/1968 Ventura ..... 16/54

*Primary Examiner*—Robert L. Spruill

*Assistant Examiner*—Carmine Cuda

*Attorney, Agent, or Firm*—Mallinckrodt & Mallinckrodt

[57] ABSTRACT

A hydraulic hinge that includes an elongated tubular member in which a first ring member with an axial opening and a downward projection is fixed and a second ring member having an opening aligned with the opening of the first ring member and a notched portion having a cam face to abut against the projection of the first ring is provided. A hollow shaft with a closed bottom and a first fluid filled piston chamber within the same is inserted through the openings of the first and second ring members, whereat the second ring member is sealed in a sleeve around the hollow shaft. The hollow shaft has an opening formed adjacent to its bottom closed. A seal member is sealed around the hollow shaft wherein the inner surface of the elongated tubular member, the second ring member, the seal member and the outer wall surface of the hollow shaft cooperatively confine a second fluid filled chamber which is in communication with the first hydraulic chamber through the opening.

2 Claims, 11 Drawing Sheets

HYDRAULIC HINGE

BACKGROUND OF THE INVENTION

1. Field of Invention

This invention relates to a hinge, more particularly to a hydraulic hinge by which when attached to a door and a door frame and said door is adapted to be pushed open in a predetermined wide angle, a mere push at that particular position will create a self-closing action.

2. Description of the Related Art

Self-closing door hinges are known in the art. Examples of such door apparatuses are disclosed in U.S. Pat. Nos. 1,644,249 and 2,641,794, the latter introducing a door closing hinge with a helical spring attached to the top of the door in such a direction that the unwinding torque it exerts tends to close the door once the door is opened, and a second hinge attached to the bottom of the door which has a helical spring lighter than the helical spring of the first hinge and wound in a direction reverse to that of the same. The action of two helical springs prevents the door from slamming when it closes. A main disadvantage of this hinge is that two complementary hinges with two different helical spring arrangements are needed. This makes the particular hinge more expensive and the installation of the hinges more troublesome for the user.

SUMMARY OF THE INVENTION

It is therefore an object of the present invention to provide a hydraulic hinge which employs a torsion spring which is wound when the door to which the hinge is attached, is opened to keep said door in a predetermined angle wide and exerts an unwinding force on said torsion spring which tends to return the door back to normally closed position, and a hydraulic retarding means to arrest the closing of the door to prevent from slamming.

Accordingly, the hydraulic hinge of the present invention that includes a first hinge leaf with a first and second tubular knuckle spaced from the first knuckle and a second hinge leaf having a third knuckle aligned with the first and second knuckle. The first, third and second knuckle cooperatively confine an elongated tubular member. A first ring member with an axial opening therethrough that includes a mounting ring is fixed to the first knuckle and has a hollow cylinder member spaced from the inner wall of the first knuckle which extends upwardly and a projection that extends downwardly from the mounting ring of the first ring member. A second ring member with an opening aligned with the opening of the first ring member that has a notched portion opened at its top with a cam face to abut against the projection of the first ring member, is disposed in the third knuckle in such a manner that it can rotate with the third knuckle and simultaneously moves axially and within a limited range within the same. A hollow shaft with a confined hydraulic chamber within the same, is inserted through the first and second ring members whereat the second ring member is sealed in a sleeve around the hollow shaft. The shaft has a first open end and a second closed end respectively located in the first and second knuckle. An opening is formed adjacent to the closed end of the hollow shaft which extends from the hydraulic chamber, gradually enlarging therefrom. A torsion spring has one end attached to the first end of the hollow shaft and the other end attached to the first ring member. A slidable piston is provided in the hydraulic chamber. A compression spring disposed in the hydraulic chamber biases the piston downward. A seal member seals around the hollow shaft in the third knuckle. The second ring member, the seal member, the inner wall of the third knuckle and the outer wall of the hollow shaft cooperatively confine an annular hydraulic chamber filled with fluid and in communication with the hydraulic chamber through a floating valve. The floating valve has a hole therethrough. A helical spring sleeved around the hollow shaft between the seal member and the second ring member biases the second ring member upward. A pin member connects the third knuckle to the hollow shaft so that they both can rotate together. During operation of the apparatus, the fluid flow of the hydraulic oil from one chamber to another causes a retarding effect which prevents the door from slamming while it closes.

BRIEF DESCRIPTION OF THE DRAWINGS

Other features and advantages of the present invention will become more apparent in the following detailed description, including drawings, all of which show non-limiting forms of the invention, and of which.

DETAILED DESCRIPTION OF THE PREFERRED EMBODIMENT

Figure 1:
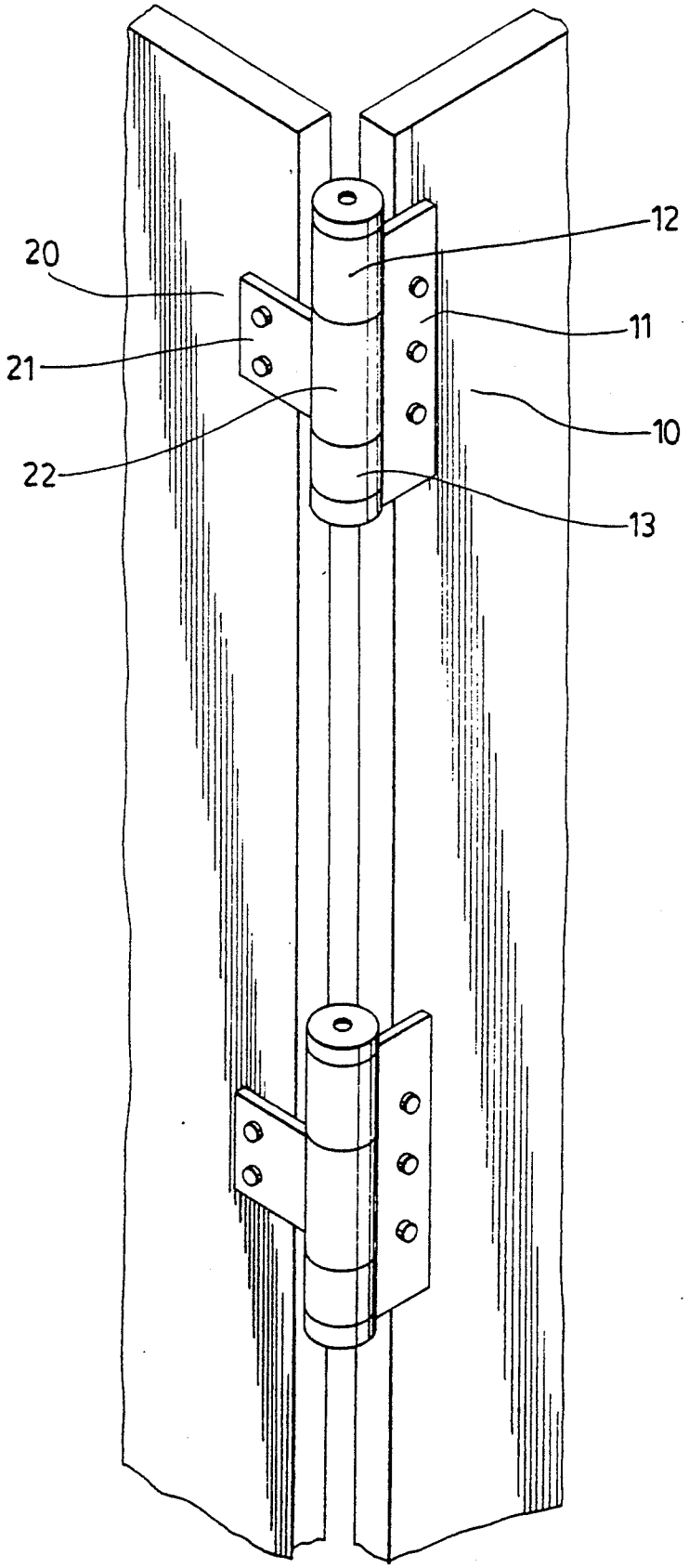
FIG. 1 shows a perspective, schematic view of a hydraulic hinge of the present invention.
Figure 2:
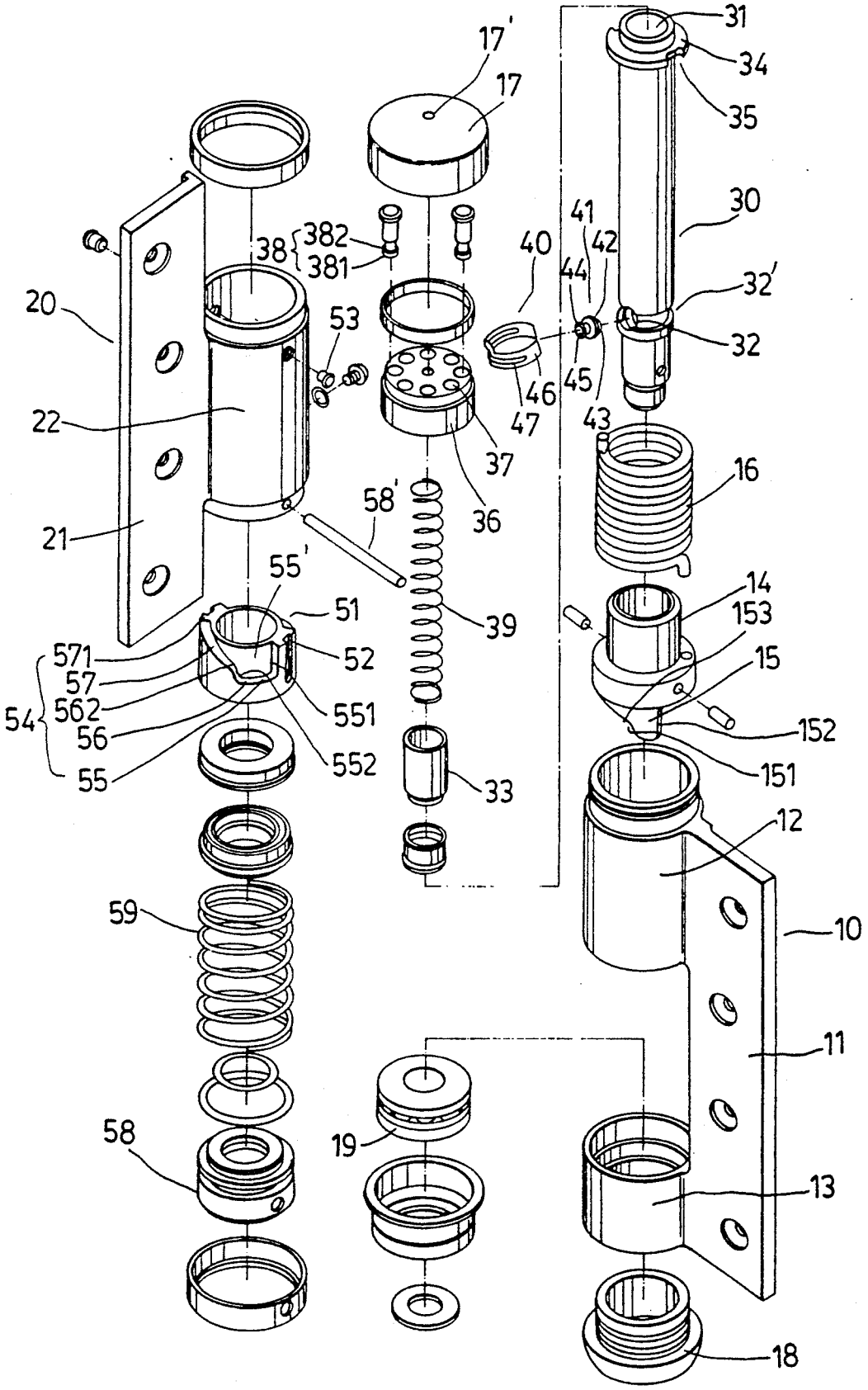
FIG. 2 is an exploded view of the hydraulic hinge of FIG. 1.

Referring to FIGS. 1 and 2, the hydraulic hinge of the present invention is shown to comprise a first hinge leaf (11) attached to a door frame (10) and having a first and a second knuckle (12,13) spaced apart from one another, a second hinge leaf (21) attached to the door (20) and having a third knuckle (22).

The third knuckle (22) is disposed between and aligned with the first and second knuckle of the first hinge leaf and cooperatively confines an elongated tubular member with two caps (17,18) respectively at the top and bottom. The cap (17) has an opening (17') therein.

A first ring member (14) with an opening therethrough that includes a mounting ring, is fixed in the first knuckle (12) by two radial pins inserted through the wall of the same. The first ring (14) also has a cylinder member spaced from an inner surface of said first knuckle and extending upward from the inner periphery of the mounting ring and a projection (15) extending downward from the outer periphery of the mounting ring of the first ring member (14). The projection (15) has an inclined cam edge (151) and a vertical cam edge (152). The inclined cam edge (151) is curved at one portion (153) thereof.

A second ring member (51) is a tubular member with an opening aligned with the opening of the first ring member (14), and has a top flat end, a bottom end, two opposite outer axial slots (52) and a recessed groove (54) on its outer surface. The recessed groove (54) includes a narrow lower section (55) and a wide upper section (55'). The narrow section (55) has a bottom portion, a top portion, a first cam edge (551) and a second cam edge(552). The wide upper section (55') that includes a first cam edge aligned with the first cam edge (551) of the narrow lower section (55) and a second cam edge (57) extending from the top portion (562) of the second cam edge of the narrow lower section (55) to a first position (571) on the top flat end of the second ring member (51). The second ring member (51) is fixed in the third tubular knuckle (22) by two radial pins (53) inserted through the wall of the same so that it is axially movable in the third knuckle between a second position when the pins (53) are at the top end of the slot (53) and a third position when the pins are respectively at the top and bottom end of the slots (53).

It is important to note that the projection (15) of the first ring member is configured to and slightly smaller in size when compared to the recessed groove (54) of the second ring member (51) so that it can fit in and slightly movable in the recessed groove (54) after the projection (15) is fully fitted within the same.

A hollow shaft (30) is inserted through the openings of the first and second ring members (14,51), and having a first end and a second closed end respectively located in the first and second knuckles (12,13). At this time, the second ring member (51) is sealed in a sleeve around the hollow shaft (30). A neck portion (32') with an outwardly enlarging opening (32) extends from the inner surface to the outer surface of said hollow shaft (30), is formed adjacent to the closed end of the hollow shaft (30).

Figure 5:
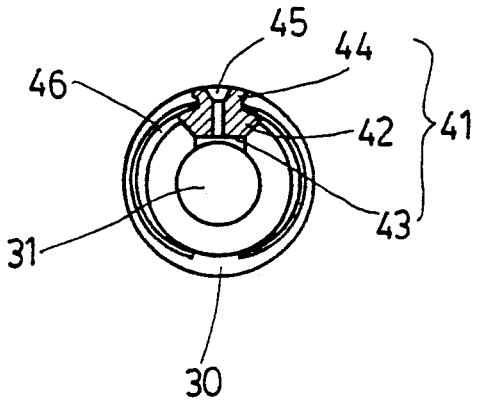
FIG. 5 is a top view of the hydraulic hinge of the present invention taken along 5—5' in FIG. 3.
Figure 6A:
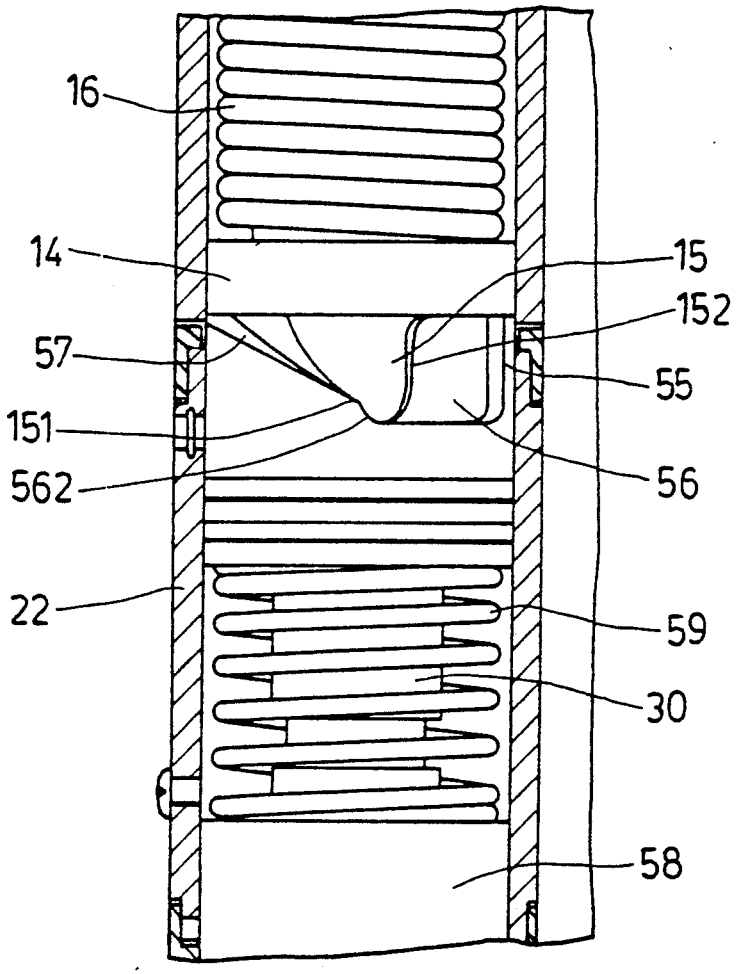
FIGS. 6(A) and (6B) respectively show the configuration of the components of the hydraulic hinge of the present invention during opening of the door to which the hinge is attached.
Figure 6B:
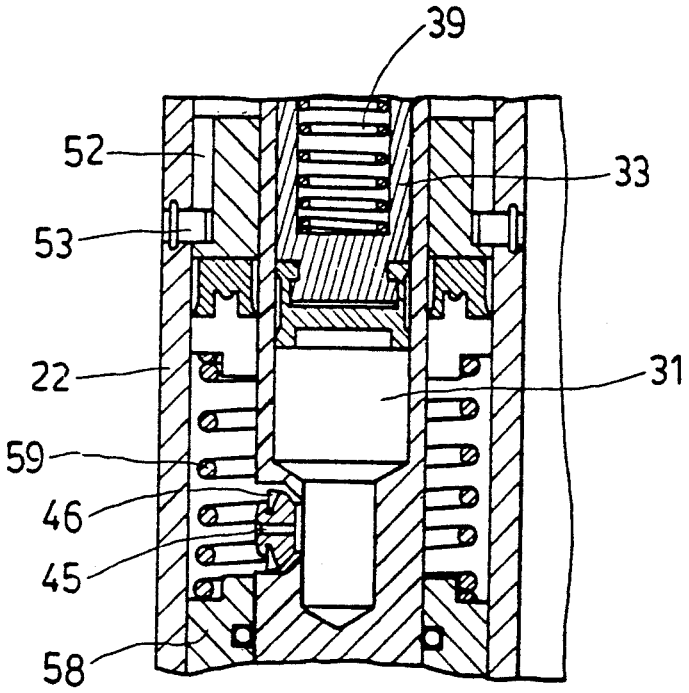

A stop member (41) has a truncated cone-shaped end (42), adapted to fit in the opening (32) of the hollow shaft and another latch end (44). The stop member (41) has a hole (45) which extends from the latch end (44) toward the truncated cone-shaped end (42). A leaf spring (46) with an opening (47) to catch the latch (44), is sleeved around the neck portion (32) to selectively plug the stop member (44) in the opening (32) of the hollow shaft (30), as shown in FIG. 5.

An annular flange (34) is formed on the hollow shaft (30) adjacent to the first end of the same with one small peripheral cut and another larger one (35).

A cap (36) with a plurality of spaced bored holes (37) at the top end and a receiving space at the bottom is capped over the annular flange (34). An engaging pin (38) with a latch (381) at one end, is inserted through one of the hole (37) wherein the latch (381) engages in the larger cut (35) of the annular flange (34). The pin (38) can be pressed to let the narrow portion (382) of the same engage with the smaller cut (35) of the flange (34) for adjusting engagement of the flange (34) and the cap, as illustrated in FIG. 4.

Figure 4:
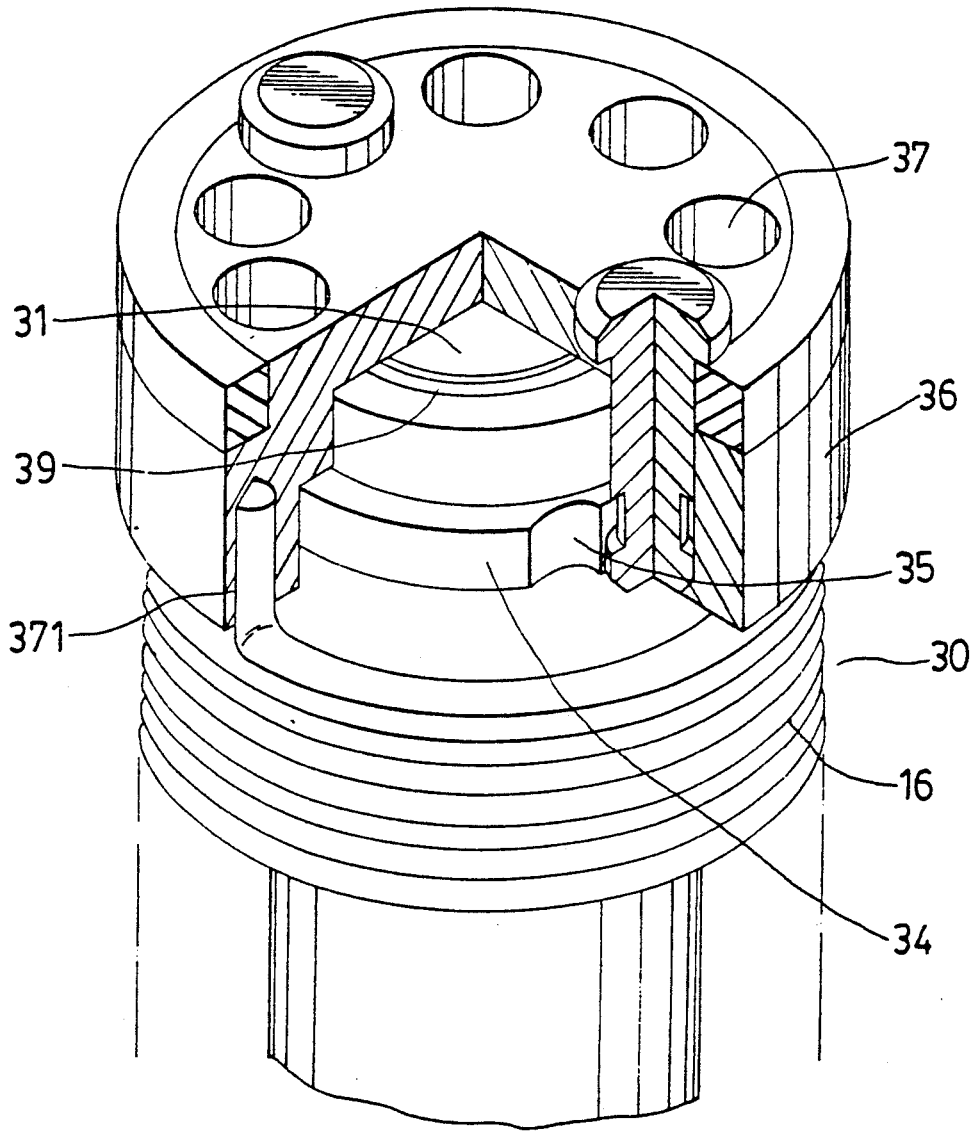
FIG. 4 illustrates a partially exploded view of the preferred embodiment of the hydraulic hinge of the present invention.

A torsion spring (16) sleeved around the tubular member of the first ring member (14), has one end attached to the mounting ring of the same and another end inserted into and fixed in the receiving space of the bottom end of the cap (36), as shown in FIG. 4, so that the unwinding force, caused by an imparted pressure of the torsion spring (16), can force the hollow shaft to rotate in a direction reverse to the direction of the imparted force.

A slidable piston (33) is provided in the hollow shaft (30) and a coil spring is provided between the cap (36) and the piston, biasing the piston downward against the cap so that it can move axially between the cap and the closed end of the hollow shaft (30). The piston and the closed end of the hollow shaft (30) cooperatively confine a first hydraulic chamber (31) filled with fluid.

A bearing (19) is provided in the second knuckle (13) to which the closed end of the hollow shaft (30) is journalled for smooth rotation.

An engaging pin (58') passes through a lower end of the third tubular knuckle (22) and the hollow shaft (30) to hold them together, so that the hollow shaft (30) can be rotated by the third knuckle.

A seal member (58) provided in the third knuckle (22) is sealed in a sleeve around the hollow shaft (30).

A helical spring (57) sleeved around the hollow shaft (30) between the second ring member (51) and the seal member (58), biases the second ring member (51) in an upward direction, so that the projection of the first ring abuts against the cam edge of the second ring member, during which time the second ring member rotates and axially moves within the third knuckle.

The second ring member (21), the seal member (58), the inner wall of the third knuckle (22) and the outer wall of the hollow shaft cooperatively confine an annular hydraulic chamber (60) filled with fluid which is in communication with the hydraulic chamber (30) through the stop member (41).

Figure 3:
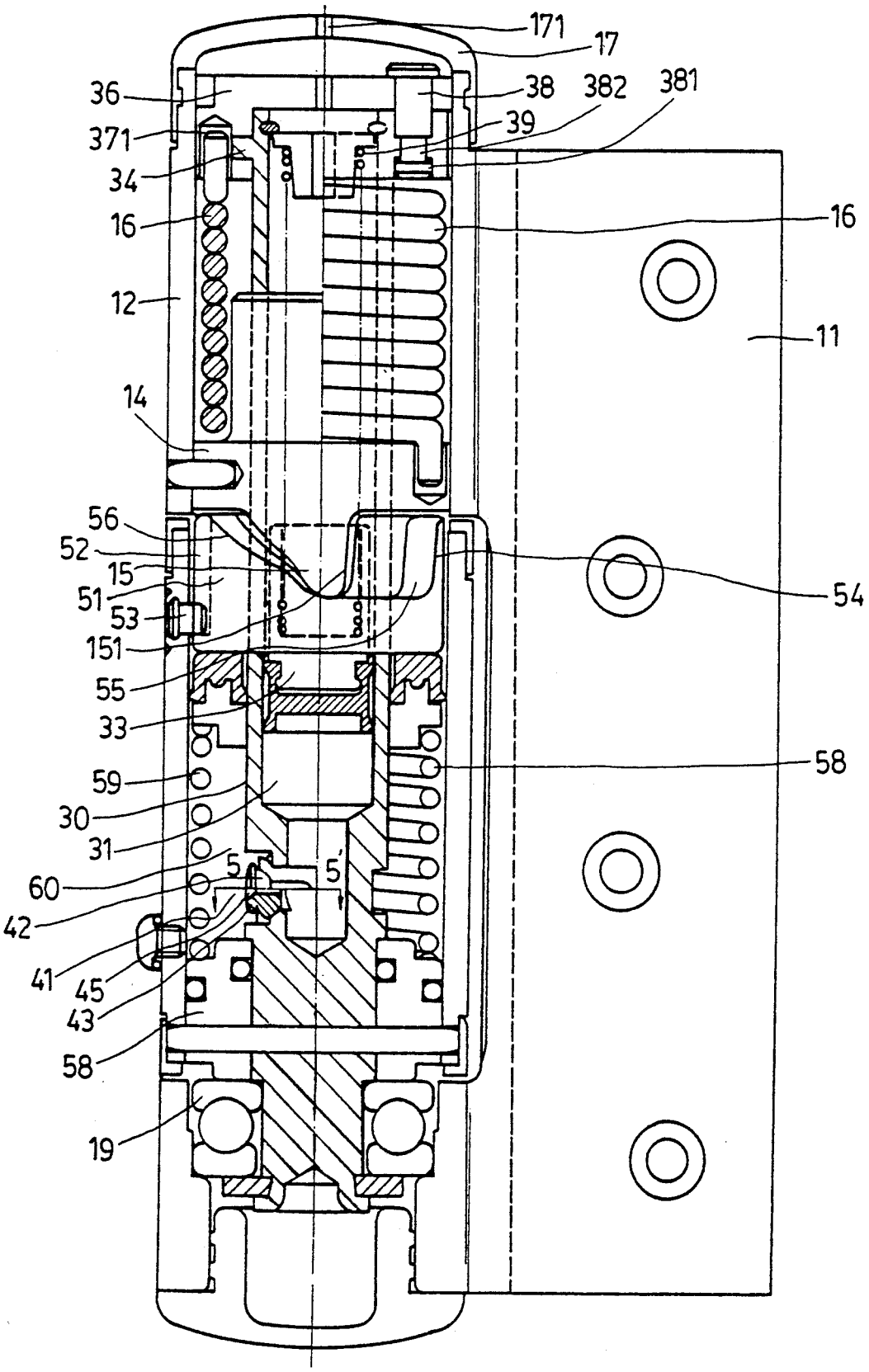
FIG. 3 is cross sectional view of the hydraulic hinge of FIG. 1.
Figure 8A:
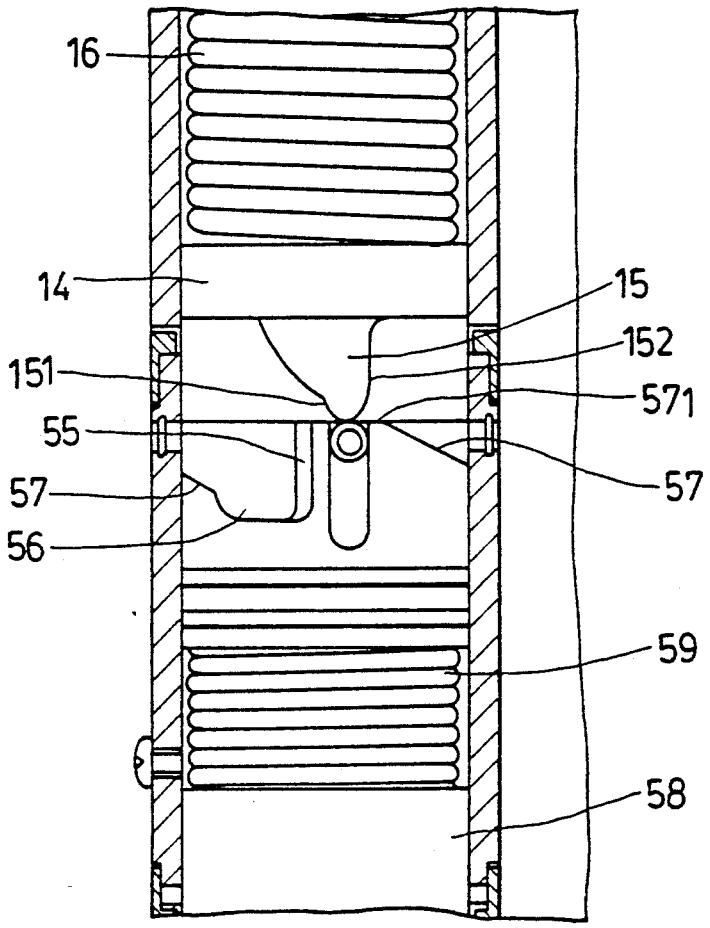
FIGS. 8(A) and 8(B) are a cross sectional views of the hydraulic hinge of the present invention at a closed position.
Figure 8B:
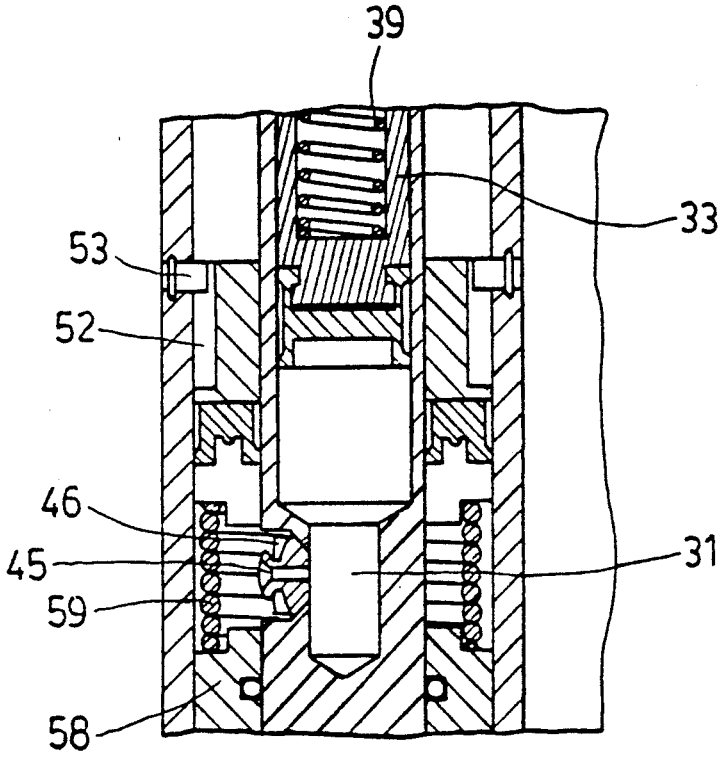

FIG. 3 shows a cross sectional view of the door apparatus thus assembled whereat the door is in an open position. Under this condition, the projection (15) of the first ring member is in the recessed groove (54) of the second ring member. FIGS. 8(A) and 8(B) shows the configuration of the present invention door apparatus in a closed position. Under this condition, the lowestmost end of the projection (15) is abutting on the first position (571) on the top flat end of the second ring member (51). At that time the second ring member (51) is at the second position in the third knuckle.

Figure 7A:
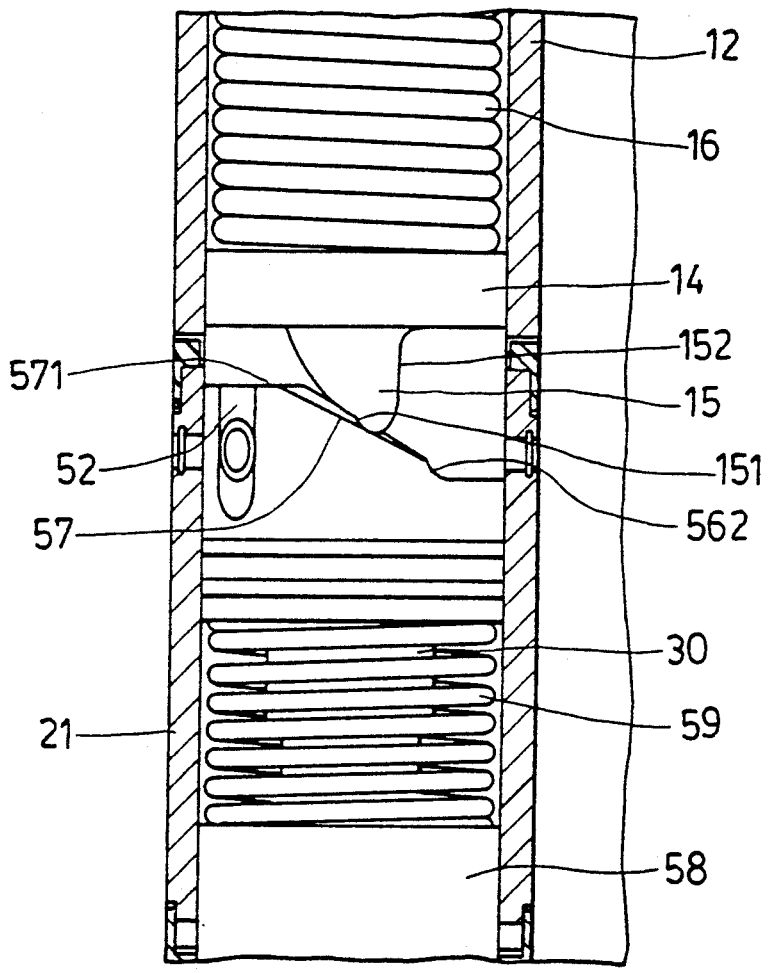
FIGS. 7(A) and 7(B) respectively show the configuration of the components of the hydraulic hinge of the present invention during closing of the door to which the apparatus is attached.
Figure 7B:
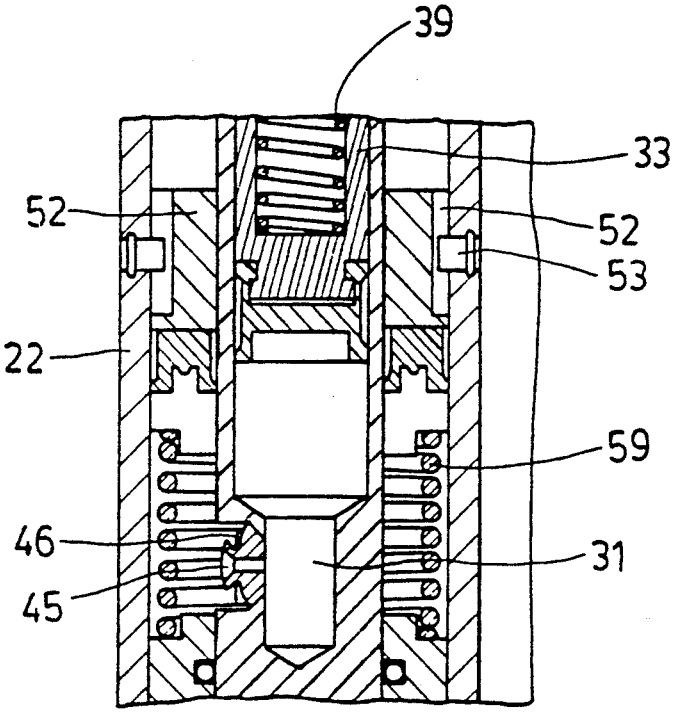

When the door to which the second hinge (20) is attached, is pushed, a winding force is exerted on the torsion spring (16) to possess an unwinding torque which extends in a direction reverse to the pushed direction, the third knuckle (22) and the hollow shaft rotate, during which time the second ring member (51) rotates and moves axially upward, as shown in FIGS. 7(A) and 7(B), due to the biasing force of the helical spring (59), the second side (57) of the wide upper section (55') of the recessed groove slide against the inclined cam face (151) of the projection (15) the first ring member. Upon reaching the narrow lower section (55) of the recessed groove, the curved portion (153) of the projection (15) engages in the narrow section (55) of the second ring member (51), whereat the door is held open 80 degrees wide respect to the closed position. The arrangement of a door at any desired angle is a known art. Alteration of the shape of the narrow lower section can arrange the door to be any desired angle relative to the closed position. During that same time, the piston (33) is pushed downwards due to the biasing force of coil spring (39). The downward movement of the piston (33) exerts a pressure on the fluid contained in the hydraulic chamber (31). Since the leaf spring (46) is lighter than the compression force of the coil spring (39), the stop member (41) is overpowered by the increase of fluid in the hydraulic chamber and pushed out of the outwardly enlarging opening, thus allowing the fluid from the hydraulic chamber (31) to flow into the annular chamber (60). Note that the increase of fluid in the annular hydraulic chamber (60) and the axial movement of the second ring member occur simultaneouly. Thus, the second member (51) is moved to the third position in the third knuckle (22) whereat a clearance remains between the first side of the recessed groove (54) of the second ring member and the vertical cam edge (152) of the first ring member (14), because of unequal sizes of the projection (15) and the recessed groove (54).

A mere push further backward at that particular position moves the projection (15) slightly in the recessed groove (54) so that the third knuckle (22) and the hollow shaft (30) rotate counter to the pushed direction due to the unwinding force of the torsion spring (16). It is important to note that the unwinding torque of the torsion spring is strong enough to overcome the engagement of the projection (15) in the narrow lower section of the recessed groove (54) of the second ring member (51). Thus, the second ring member (51) rotates and moves axially downward against the biasing force of the helical spring (59), pushing the fluid from the annular chamber (60) to flow into the hydraulic chamber through the opening of the stop member (41). The increase of fluid in the hydraulic chamber pushes the piston (33) upward against the biasing force of the coil spring in the hydraulic chamber (31). When the door is fully closed, the lowerstmost end of the projection (15) rests on the first position on the flat top end of the second ring member (51) while the second ring member (51) is moved to the second position in the third knuckle. It is important to note here that the closing of the door will be quicken before it is fully closed because when the lowestmost end of the projection (15) reaches the top flat end of the tubular member, the fluid stops flowing from the annular hydraulic chamber into the first hydraulic chamber. Thus no more retarding effects occur during that time to prevent the unwinding torque of the torsion spring (16). Since the hole (45) in the stop member is very small, the fluid flow is also smaller in comparison to the first flow from the chamber (31) into (60). Thus creating a retarding effect to arrest the closing of the door and preventing it from slamming.

With the invention thus explained,. it is obvious to those skilled in the art that various modifications and variations can be made without departing from the scope and spirit of the present invention. It is therefore, intended that this invention be treated only as in the appended claims.

I claim:

1. A hydraulic hinge comprising:

a first hinge leaf adapted to be fixed to a door frame and having a top tubular knuckle and a bottom tubular knuckle spaced from said top tubular knuckle;

a second hinge leaf adapted to be fixed to a door and having an intermediate tubular knuckle, said intermediate tubular knuckle being disposed between and aligned with said top and bottom tubular knuckles and cooperatively confining an elongated tubular member with a top one and bottom closed end;

a first ring with an axial opening, fixed in said top tubular knuckle, said first ring having a hollow cylinder member extending upwardly from an inner periphery of said first ring and a projection with an abutting end, extending downwardly from the outer periphery of said first ring;

a tubular member having an axial opening aligned with said axial opening of said first ring, disposed in said intermediate tubular knuckle and having a top flat end, a lower end and a notched portion opened at said top flat end, said notched portion including an inclined cam face extending from said top flat end towards said lower end of said tubular member, a circumferential cam face extending from said tubular member and a substantially axial cam face extending upward from said circumferential cam face to said top flat end of said tubular member, said inclined cam face, said circumferential cam face and said axial cam face cooperatively defining said notched portion, said inclined cam face having a first and second section of different slopes, said second section being steeper in comparison to said first section and formed adjacent to said circumferential cam face;

means for permitting said tubular member to move axially and simultaneously rotate with said intermediate tubular knuckle between a first position and a second position when said intermediate tubular knuckle is rotated with respect to said first hinge leaf;

a hollow shaft inserted through said axial openings of said first ring and said tubular member with said tubular member being sealed in a sleeve around said hollow shaft, said projection of said first ring being extended into said notched portion of said tubular member, said hollow shaft having a first open end and a second closed end respectively extending into said top and bottom tubular knuckles, said hollow shaft further having a neck portion formed adjacent to said second closed end with an opening, which extends gradually enlarging outward from an inner surface to an external surface of said hollow shaft;

a torsion spring disposed in said top tubular knuckle and having one end connected to said first ring and the other end connected to said top end of said hollow shaft;

means for engaging said hollow shaft with said intermediate tubular knuckle together, so that said hollow shaft can be rotated by said intermediate tubular knuckle;

a movable piston sealed in said hollow shaft;

means for biasing said piston towards said closed end of said hollow shaft;

said piston and said second closed end of said hollow shaft cooperatively forming a first hydraulic chamber;

a stop member having a truncated cone-shaped end inserted into said outwardly enlarging opening and a latch end opposite to said truncated cone-shaped end, a hole extending from said latch end towards said truncated cone shaped end;

a resilient means provided around said neck portion for urging said stop member to block said outwardly enlarging opening;

a helical spring provided around said hollow shaft between said tubular member and said closed end of said bottom knuckle in order to bias said tubular member upward and to keep said abutting end of said first ring abutting against said inclined cam face of said notehed portion of said tubular member when said tubular member rotates and moves axially between a third position where said abutting end of said projection is at said top flat end of said tubular member and a fourth position where said abutting end of said projection abuts against an intermediate place of said second section of said inclined cam face and said circumferential cam face;

said tubular member, said closed end of said bottom knuckle, an inner surface of said intermediate knuckle and an outer surface of said hollow shaft cooperatively forming a second hydraulic chamber through said stop member, said first and second hydrualic chambers being filled with a fluid;

when said first hinge leaf is rotated with respect to said second hinge leaf against the winding force of said torsion spring in a first direction, said tubular member is rotated and moved upward whereby said projection of said first ring is moved from said first position to said second position along said inclined cam face and the fluid in said first hydraulic chamber pushes said stop member out of said outwardly enlarging opening by the downward biasing force of said coil spring so that fluid flows into said second chamber, said door being opened at a predetermined angle with said abutting end of said projection being abutted against and engaged at said intermediate place of said inclined cam face and said circumferential cam face; and when said first hinge leaf is rotated in a second direction opposite to said first direction by the unwinding force of said torsion spring after said first hinge is moved by a force sufficient to allow said abutting end of said projection to disengage said abutting end from said intermediate place of said inclined cam face and said circumferential cam face of said notched portion, the fluid in said second hydraulic chamber pushes said stop member to plug said outwardly enlarging opening and flow into said first chamber through said opening of said stop member so that said abutting end of said projection can slowly move from said second position to said first position, thereby closing said door.

2. A hydraulic hinge as claimed in claim 1, wherein said predetermined angle is 80 degrees.

* * * * *